United States Patent [19]

Eda et al.

[11] 4,266,870

[45] May 12, 1981

[54] ELECTROSTATOGRAPHIC APPARATUS COMPRISING DEVELOPING BIAS MEANS

[75] Inventors: Tadahiro Eda; Susumu Tatsumi; Chikara Imai, all of Tokyo, Japan

[73] Assignee: Ricoh Company, Ltd., Tokyo, Japan

[21] Appl. No.: 17,856

[22] Filed: Mar. 6, 1979

[30] Foreign Application Priority Data

| | | | |
|---|---|---|---|
| Mar. 9, 1978 | [JP] | Japan | 53-26934 |
| Jun. 27, 1978 | [JP] | Japan | 53-78257 |
| Jun. 30, 1978 | [JP] | Japan | 53-79654 |

[51] Int. Cl.[3] ..... G03G 15/00

[52] U.S. Cl. ..... 355/14 D; 118/668; 324/457; 355/3 DD

[58] Field of Search ..... 355/3 R, 3 DD, 14 R, 355/14 D; 324/452, 455, 457, 458; 118/647, 648, 651, 665, 668, 712

[56] References Cited

U.S. PATENT DOCUMENTS

| | | | |
|---|---|---|---|
| 3,611,982 | 10/1971 | Coriale et al. | 118/648 X |
| 3,852,668 | 12/1974 | Hardenbrook et al. | 324/72 |
| 3,921,087 | 11/1975 | Vosteen | 324/79 R X |
| 4,063,154 | 12/1977 | Andrus et al. | 324/455 |
| 4,063,155 | 12/1977 | Buchheit | 324/455 |
| 4,079,266 | 3/1978 | Vipond | 355/14 D X |
| 4,141,643 | 2/1979 | Eda et al. | 118/648 X |

*Primary Examiner*—Fred L. Braun

*Attorney, Agent, or Firm*—David G. Alexander

[57] ABSTRACT

An electrode (17) is provided adjacent to a photoconductive drum (12) to sense the background area potential at a leading edge of an electrostatic image on the drum (12). An electrically conductive shield (26) surrounds all surfaces of the electrode (17) except a surface which faces the drum (12). A voltage follower (18) has an input connected to the electrode (17) and an output connected to the shield (26). This makes the capacitance between the electrode (17) and the drum (12) much greater than the capacitance between the electrode (17) and ground. The surface of the electrode (17) facing the drum (12) is formed with a pattern of projections and depressions to increase the surface area thereof and thereby the capacitance between the electrode (17) and the drum (12). The output of the voltage follower (18) is connected through a sample and hold circuit (53), (54), (56), (57), (62) to a developing bias voltage generator (58), (69), (71) which applies a bias voltage to a developing unit (23) in accordance with the output of the voltage follower (18) and thereby the potential of the electrostatic image on the drum (12).

6 Claims, 8 Drawing Figures

ELECTROSTATOGRAPHIC APPARATUS COMPRISING DEVELOPING BIAS MEANS

BACKGROUND OF THE INVENTION

The present invention relates to an improved electrostatographic apparatus such as an electrostatic copying machine comprising improved means for generating and applying a bias voltage to a developing unit.

An electrostatographic apparatus of the present type is disclosed in U.S. Pat. No. 4,050,806 which is assigned to the same assignee as this application. An electrode is disposed closely adjacent to the surface of a photoconductive drum to sense the potential of an electrostatic image thereon. A voltage is induced in the electrode which is proportional to the electrostatic image potential and is fed to a computing circuit which generates a developing bias voltage in accordance therewith. The bias voltage which is applied to a developing unit is slightly greater than the potential of the background areas of the electrostatic image and prevents the formation of a gray background in the finished copy. Preferably, more than one electrode is provided and the minimum output of the electrodes is selected since it corresponds to the background area potential. A similar arrangement is disclosed in U.S. Pat. No. 3,892,481.

A problem which has existed heretofore regards the capacitances between the electrode, the drum and ground. Since the capacitance between the electrode and ground is comparable in magnitude to that between the electrode and the drum, only a fraction of the potential induced on the electrode appears at the input of an amplifier connected to the electrode. This is because the capacitances between the electrode, the drum and ground constitute a voltage divider.

Since the voltage at the input of the amplifier is only on the order of 1/100 or 1/1000 the magnitude of the electrostatic potential on the drum, a small error in the sensed voltage results in a large error in the applied bias voltage. This problem is compounded by temperature drifts and zero points shifts in the amplifier. A prior art expedient for compensating zero point shift is disclosed in U.S. Pat. No. 3,852,668 and comprises a shutter means provided to the electrode. Temperature drift has been reduced by providing the amplifier with stabilizing circuitry or mounting the amplifier in a constant temperature enclosure.

However, these expedients are only partially acceptable solutions to the problems.

Yet another problem is that the gap between the electrode and the drum is critical since it determines the capacitance between the electrode and drum and thereby the magnitude of the signal output. A large variation in signal output is produced by a small change in the gap.

SUMMARY OF THE INVENTION

The present invention overcomes the problems of the prior art by providing means to maintain the capacitance between the electrode and the drum much greater than the capacitance between the electrode and ground. This ensures that substantially all of the potential induced on the electrode will appear at the input of an amplifier connected thereto and that the gap between the electrode and the drum will be non-critical.

An electrostatographic apparatus embodying the present invention includes a photoconductive member and image forming means for forming an electrostatic image on the photoconductive member. An electrode is disposed closely adjacent to the photoconductive member, an electrostatic potential corresponding to an electrostatic potential of the electrostatic image on the photoconductive member being induced on the electrode. Means are provided for maintaining a capacitance between the electrode and the photoconductive member greater than a capacitance between the electrode and ground.

In accordance with the present invention, an electrode is provided adjacent to a photoconductive drum to sense the background area potential at a leading edge of an electrostatic image on the drum. An electrically conductive shield surrounds all surfaces of the electrode except a surface which faces the drum. A voltage follower has an input connected to the electrode and an output connected to the shield. This makes the capacitance between the electrode and the drum much greater than the capacitance between the electrode and ground. The surface of the electrode facing the drum is formed with a pattern of projections and depressions to increase the surface area thereof and thereby the capacitance between the electrode and the drum. The output of the voltage follower is connected through a sample and hold circuit to a developing bias voltage generator which applies a bias voltage to a developing unit in accordance with the output of the voltage follower and thereby the potential of the electrostatic image on the drum.

It is an object of the present invention to provide an improved electrostatographic apparatus comprising an electrode for sensing an electrostatic potential on a photoconductive drum and means for maintaining the capacitance between the electrode and the drum much higher than the capacitance between the electrode and ground.

It is another object of the present invention to provide an electrostatographic apparatus comprising an electrode for sensing an electrostatic potential on a photoconductive drum and means for increasing a magnitude of an induced voltage on the electrode.

It is another object of the present invention to provide an electrostatographic apparatus comprising means for sensing an electrostatic potential on a photoconductive drum which are more accurate than has heretofore been possible.

It is another object of the present invention to provide an electrostatographic apparatus comprising an electrode for sensing an electrostatic potential on a photoconductive drum and means for minimizing the effect of the gap between the electrode and the drum on the potential induced in the electrode.

It is another object of the present invention to provide a generally improved electrostatographic apparatus.

Other objects, together with the foregoing, are attained in the embodiments described in the following description and illustrated in the accompanying drawing.

DESCRIPTION OF THE PREFERRED EMBODIMENTS

While the electrostatographic apparatus of the present invention is susceptible to numerous physical embodiments, depending upon the environment and requirements of use, substantial numbers of the herein shown and described embodiments have been made, tested and used, and all have performed in an eminently satisfactory manner.

Figure 1:
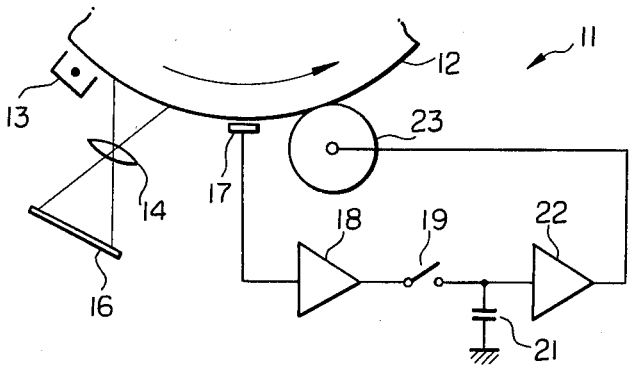
Fig. 1 PRIOR ART
FIG. 1 is a schematic view of a prior art electrostatographic apparatus.

Referring now to FIG. 1 of the drawing, a prior art electrostatographic apparatus is generally designated by the reference numeral 11 and comprises a photoconductive drum 12 which is rotated counterclockwise at constant speed. A corona charging unit 13 applies a uniform negative electrostatic charge to the drum 12 in the dark. An imaging system symbolized by a converging lens 14 focusses a light image of an original document 16 onto the drum 12 to form an electrostatic image through localized photoconduction. A sensing electrode 17 is disposed closely adjacent to the drum 12 so that an electrostatic voltage or potential proportional to the potential on the drum 12 is induced in the electrode 17.

A voltage follower or unity gain amplifier 18 has an input connected to the electrode 17 and an output connected to a switch 19. The switch 19 is connected to ground through a capacitor 21 and also to the input of a bias voltage generator 22. The output of the bias voltage generator 22 is connected to a magnetic brush developing unit 23. The developing unit 23 applies toner to the drum 12 to produce a toner image of the document 16 by means of electrostatic attraction. The toner image is transferred and fixed to a copy sheet to provide a permanent reproduction of the document 16 although not illustrated.

The switch 19 and capacitor 21 constitute a sample and hold circuit. The switch 19 is closed when the leading edge portion of the electrostatic image on the drum 12 is adjacent to the electrode 17. The leading edge portion is generally a white background area so that the potential on the electrode 17 at this time corresponds to the background area potential of the electrostatic image. The capacitor 21 is charged to this potential which is applied to the input of the bias voltage generator 22. The generator 22 is provided with high input impedance so that the capacitor 21 does not discharge but holds the sampled voltage. After the leading edge portion of the electrostatic image passes the electrode 17 the switch 19 is opened.

The generator 22 produces an output bias voltage which is slightly greater than the background potential on the drum 12 and applies the same to the developing unit 23. The bias voltage prevents toner transfer to the background areas and thereby ensures that the background areas will print white on the copy. If desired, the electrode 17 may be replaced by a plurality of electrodes and means for selecting the lowest potential on the electrodes.

Figure 2:
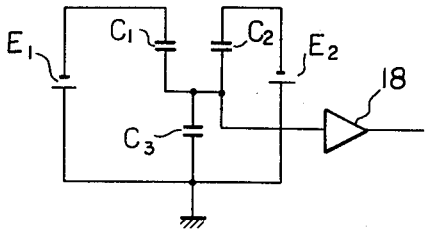
Fig. 2 PRIOR ART
FIG. 2 is a diagram illustrating the capacitance between an electrode, a photoconductive drum and ground in the prior art apparatus.

The problems which have existed heretofore are illustrated in FIG. 2. The electrostatic potential between the black image areas on the drum 12 and the electrode 17 is designated as E2 and the capacitance between the black image areas and the electrode 17 is designated as C2. The potential between the white background image areas on the drum 12 and the electrode 17 is designated as E1 and the capacitance between the white image areas and the electrode 17 is designated as C1. The capacitance between the electrode 17 and ground is designated as C3.

Since a typical printed document will consist of about 95% white background areas and 5% black character areas, C1 is much greater than C2. Although the induced potential on the electrode 17 is the weighted average of the potentials E1 and E2, especially in a leading edge area which most probably is entirely white, the contribution of E2 may be neglected since C1 is so much greater than C2. Thus, the potential which appears at the input of the amplifier 18 is approximately equal to $E1[C1/(C1+C3)]$. It will thus be seen that where the value of C3 is substantial, the voltage which appears at the input of the amplifier 18 is only a fraction of the potential between the background areas of the image and the electrode 17. This low potential increases the problems of temperature and zero point drift and makes the gap between the drum 12 and the electrode 17 critical.

This problem is partially overcome in accordance with the present invention by increasing the surface area of the portion of the electrode 17 which faces the drum 12. This may be accomplished by stamping, molding or otherwise forming a pattern of projections and depressions on the surface. The pattern may have any configuration as long as the surface area is greater than that of a flat surface. Alternatively, the surface of the electrode 17 facing the drum 12 may be oxidized, aluminized or subjected to any other type of surface treatment which increases the capacitance between the electrode 17 and the drum 12. An insulating coating may also be formed on the electrode 17 to ensure stable operation under conditions of high humidity and corrosive atmosphere.

Figure 3:
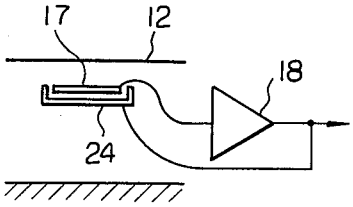
FIG. 3 is a simplified diagram illustrating how problems of the prior art are overcome in accordance with the present invention.

FIG. 3 illustrates an effective means of reducing the capacitance C3 between the electrode 17 and ground close to zero. This ensures that the entire potential E1 between the electrode 17 and the drum 12 appears at the input of the voltage follower or amplifier 18. In accordance with the present invention, an electrically conductive shield 24 surrounds all portions of the electrode 17 except for the surface which faces the drum 12. In addition, the output of the voltage follower 18 is connected to the shield 24. This maintains the potential between the electrode 17 and shield 24 at less than 0.05 V, and effectively reduces the capacitance C3 close to zero. The shield 24 also prevents electrical noise from cables and the like in the apparatus from being induced in the electrode 17. The voltage follower 18 may be the same as used in the prior art apparatus 11 and preferably has an input impedance of at least $10^{13}$ to $10^{17}$ ohms, an input capacitance below 0.001 pfd and an input voltage range of $\pm 500$ V. The voltage follower 18 further has low input noise and low input current characteristics.

Figure 5:
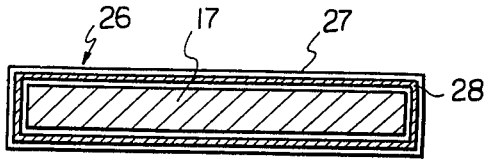
FIG. 5 is plan view illustrating an electrode and peripheral shield of the apparatus.
Figure 6:
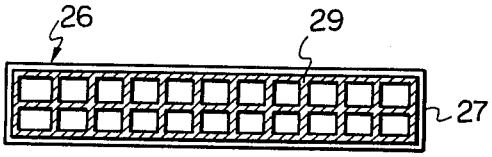
FIG. 6 is similar to FIG. 5 but illustrates a rear shield of the apparatus.

A practical embodiment of the shield 24 is illustrated in FIGS. 5 and 6 and designated as 26. The electrode 17 is fixed to an electrically insulative plate 27, with the exposed surface of the electrode 17 facing the drum 12. A peripheral shield member 28 is also fixed to the plate 27 and surrounds the periphery of the electrode 17. The electrode 17 and shield member 28 are separated from each other by a portion of the plate 27.

FIG. 6 illustrates the back side of the plate 27 on which is fixed a rear shield member 29 in the form of a coarse wire mesh. The rear shield member 29 is separated from the electrode 17 by the thickness of the plate 27. The output of the voltage follower 18 is connected to both shield members 28 and 29. The shield member 29 is provided in the form of a mesh since it serves its intended function of shielding the back side of the electrode 17 but has only negligible capacitance between itself and the electrode 17 as compared to a solid rear shield member.

Figure 4:
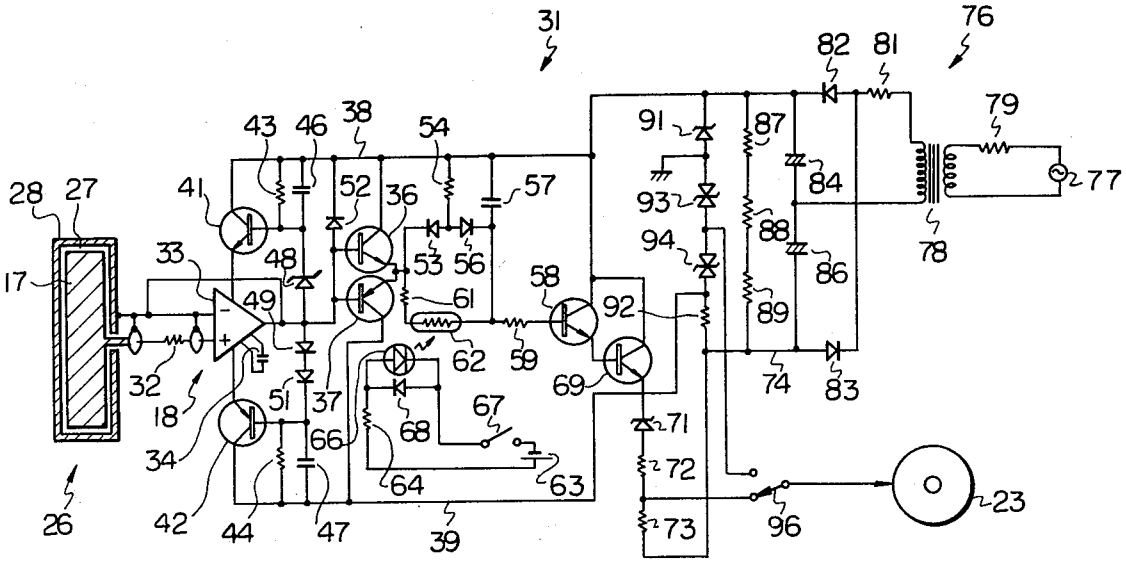
FIG. 4 is an electrical schematic diagram of the present apparatus.

FIG. 4 illustrates a practical embodiment of the present apparatus which is designated as 31 and comprises the electrode 17 and shield 26 described in conjunction with FIGS. 5 and 6. The electrode 17 is connected through a resistor 32 to the non-inverting input of an operational amplifier 33 which constitutes the main element of the voltage follower 18. The operational emplifier 33 is provided with a compensation capacitor 34. The output of the operational amplifier 33 is connected to the inverting input thereof, to the shield 26 and to the bases of an NPN transistor 36 and a PNP transistor 37.

The collectors of an NPN transistor 41 and a PNP transistor 42 are connected to positive and negative power supply lines 38 and 39 respectively. The emitters of the transistors 41 and 42 are connected to positive and negative supply terminals of the operational amplifier 33 respectively. The bases of the transistors 41 and 42 are connected to the lines 38 and 39 through resistors 43 and 44 in parallel with capacitors 46 and 47 respectively. The cathode of a zener diode 48 is connected to the base of the transistor 41, the anode of the zener diode 48 being connected to the output of the operational amplifier 33. The output of the operational amplifier 33 is also connected to the anode of a diode 49, the cathode of which is connected to the anode of a diode 51. The cathode of the diode 51 is connected to the base of the transistor 42. The transistors 41 and 42, zener diode 48 and associated components are included to provide high temperature stability to the power supply of the operational amplifier 33.

The base of the transistor 36 is connected to the anode of a diode 52, the cathode of which is connected to the line 38. The collectors of the transistors 36 and 37 are connected to the lines 38 and 39 respectively. The emitters of the transistors 36 and 37 are connected together and also to the cathode of a diode 53. The anode of the diode 53 is connected to the line 38 through a resistor 54 and also to the anode of a diode 56. The cathode of the diode 56 is connected to the line 38 through a capacitor 57 and also to the base of an NPN transistor 58 through a resistor 59. The emitter of the transistor 36 is connected through a resistor 61 and cadmium sulfide photocell 62 to the cathode of the diode 56.

The positive terminal of a D.C. power source 63 is connected through a resistor 64 to the anode of a light emitting diode (LED) 66. The cathode of the LED 66 is connected through a switch 67 to the negative terminal of the source 63. The cathode of a diode 68 is connected to the anode of the LED 66, with the anode of the diode 68 being connected to the cathode of the LED 66.

The emitter of the transistor 58 is connected to the base of an NPN transistor 69 in a Darlington configuration. The collectors of the transistors 58 and 69 are connected to the line 38. The emitter of the transistor 69 is connected to the cathode of a zener diode 71, the anode of which is connected through resistors 72 and 73 to a line 74.

The apparatus 31 further comprises a power supply 76 which includes an A.C. source 77. The source 77 is connected to the primary winding of a power transformer 78 through a resistor 79. One end of the secondary winding of the transformer 78 is connected through a resistor 81 to the anode of a diode 82, the cathode of the diode 82 being connected to the line 38. The anode of the diode 82 is also connected to the cathode of a diode 83, the anode of which is connected to the line 74. Capacitors 84 and 86 are connected in series between the lines 38 and 74, with the other end of the secondary winding of the transformer 78 being connected to the junction of the capacitors 84 and 86.

Resistors 87, 88 and 89 are connected in series between the lines 38 and 74. The line 38 is further connected to the cathode of a zener diode 91, the anode of which is connected to ground. The line 74 is connected to ground through a resistor 92 and varistors 93 and 94 which stabilize the power supply 76 against variations in temperature. The junction of the varistor 94 and the resistor 92 is connected to the line 39. A switch 96 is changeable to selectively connect the junction of the resistors 72 and 73 or the junction of the varistors 93 and 94 to the developing unit 23.

The diodes 82 and 83 in combination with the capacitors 84 and 86 function as a voltage doubler to provide a voltage across the lines 38 and 74 equal to twice the peak voltage across the secondary winding of the transformer 78. The zener diode 91 has a zener voltage of 6 V to 18 V so that the line 38 maintained at +6 V to +18 V according to the zener voltage. The voltage at the line 74 is maintained at about −620 V. The zener voltage of the zener diode 71 is on the order of 80 V.

In operation, the switch 67 is closed by a cam or the like (not shown) connected to the drum 12 when the leading edge of the electrostatic image is adjacent to the electrode 17. The switch 67 is closed long enough to allow a voltage corresponding to the leading edge potential on the drum 12 to be induced in the electrode 17, and is then opened.

The LED 66 in combination with the cell 62 constitute an optocoupler. The resistance of the cell 62 is very high in the absence of light. However, when the switch 67 is closed the LED 66 is energized by the source 63 and emits light which renders the cell 62 highly conductive.

The voltage follower 18 and transistors 36 and 37 produce an output which is equal to the voltage on the electrode 17 and which is fed back to the shield 26 as described hereinabove. This voltage appears at the emitter of the transistor 36 and is applied to the capacitor 57 through the resistor 61 and cell 62 only when the switch 67 is closed. The resistor 61 is selected to have a low value so that the capacitor 57 charges to the voltage at the emitter of the transistor 36 almost instantaneously. Since the electrostatic image has a negative polarity, the voltage at the cathode of the diode 56 is negative. When the switch 67 is opened, the charge across the capacitor 57 is held and applied to the transistor 58 which is selected to have a very high input impedance.

The transistors 58 and 69 amplify the voltage across the capacitor 57 so that it is equal to the corresponding electrostatic potential on the drum 12. The zener diode 71 adds 80 V to the voltage at the emitter of the transistor 69 so that the bias voltage is 80 V higher (more negative) than the electrostatic potential on the drum 12. This bias voltage appears at the junction of the resistors 72 and 73 and is applied to the developing unit 23 through the switch 96. The switch 96 may be changed over to connect a fixed voltage appearing at the junction of the varistors 93 and 94 to the developing unit 23 in case of failure of the automatic bias system or the like.

The diodes 53 and 56, resistor 54 and capacitor 57 constitute what is known in the art as a re-hold circuit. The purpose of this circuit is to compensate the bias voltage in case of an unusual document which has a black leading edge portion. In this case, the voltage across the capacitor 57 which is amplified to produce the bias voltage is too high and will result in washed out image areas if not corrected.

This function is accomplished by the re-hold circuit. As long as the voltage at the emitter of the transistor 36 is more negative than the voltage across the capacitor 57, indicating that the currently sensed potential is higher than the potential sensed when the switch 67 was closed, the diode 56 is reverse biased and prevents the capacitor 57 from discharging. The diode 53 functions to couple the emitter voltage of the transistor 36 to the junction of the diode 56 and resistor 54 but prevent reverse current flow to the transistor 36.

If the potential at the emitter of the transistor 36 and thereby at the anode of the diode 53 should become less negative than the voltage across the capacitor 57, which occurs when the currently sensed potential is lower than the potential sensed when the switch 67 was closed, the diode 56 will be forward biased and allow the capacitor 57 to discharge through the resistor 54 to the potential at the anode of the diode 53. The final potential across the capacitor 57 will be equal to the currently sensed, lower potential at the emitter of the transistor 36. If the potential at the emitter of the transistor 36 rises, the diode 56 will again be reverse biased and prevent discharge of the capacitor 57. The rate of discharge of the capacitor 57 through the resistor 54 is determined by the time constant of these components. It will thus be seen that the re-hold circuit functions to prevent the capacitor 57 from being discharged when the potential on the drum 12 is higher than the potential at the leading edge of the electrostatic image. However, if the potential on the drum 12 drops below the potential in the leading edge portion, which occurs when a document such as a photograph has a black leading edge portion, the re-hold circuit will cause the capacitor 57 to automatically discharge to a level corresponding to the sensed potential.

The zener diode 91 places the line 38 at a low positive potential, thereby allowing the voltage follower 18 to operate at voltages close to zero and also at low positive voltages which appear when the charger 13 is turned off and then on and applied a low reverse charge to the drum 12.

Figure 7:
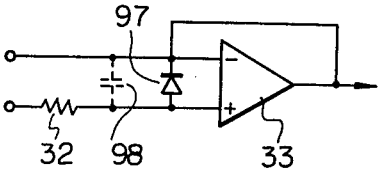
FIG. 7 is a schematic diagram illustrating a modification of the apparatus.

FIG. 7 illustrates a modification which may be used either in combination with or as a replacement for the zener diode 91. The modification comprises a diode 97 having its cathode connected to the inverting input of the operational amplifier 33 and its anode connected to the non-inverting input of the operational amplifier 33. Designated by the reference numeral 98 is a capacitor which constitutes the input capacitance of the operational amplifier 33.

The diode 97 functions to discharge the capacitor 98 in the event of reverse charging of the drum 12 as mentioned hereinabove. Thus, the voltage follower 18 produces a substantially zero output in response to a positive input.

Figure 8:
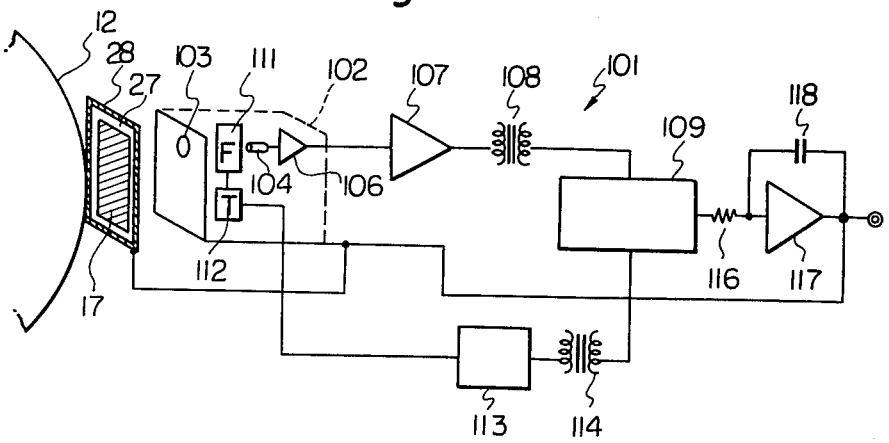
FIG. 8 is a schematic diagram illustrating another apparatus in accordance with the present invention.

The present invention may further be applied, as illustrated in FIG. 8, to an electrostatographic apparatus using an electrometer of the type disclosed in U.S. Pat. No. 3,921,087 to measure the potential induced on the electrode 17. In this case, the rear shield member 28 is omitted from the electrode assembly.

The electrometer is designated as 101 and comprises an electrically conductive enclosure 102 which is formed with a small hole 103 facing the electrode 17. A cylindrical electrode 104 is aimed at the electrode 17 through the hole 103 so that a potential proportional to the potential on the electrode 17 is induced on the electrode 104. The input of a voltage follower 106 is connected to the electrode 104. The output of the voltage follower 106 is connected to a signal amplifier 107, the output of which is connected through an isolation transformer 108 to a phase sensitive detector 109.

Although not illustrated in detail, a tuning fork tine assembly 111 is mounted in front of the electrode 104 and driven by an electromechanical transducer 112. The tines are connected to the ends of the tuning fork so as to vibrate toward and away from each other when energized by the transducer 112. The tines almost touch and block the electrode 104 in one extreme position and move away from each other and unblock the electrode 104 in another extreme position. This has the effect of modulating the electrostatic potential induced in the electrode 104. The transducer 112 is driven by a reference oscillator 113 which also feeds its output to the detector 109 through an isolation transformer 114.

The output of the detector 109 is connected through a resistor 116 to the input of an integrator 117 which is provided with a feedback capacitor 118. The output of the integrator 117 corresponds to the output of the voltage follower 18 of the apparatus 31. The output of the integrator 117 is connected to the housing 102 and peripheral shield member 28.

The reference voltage from the oscillator 113 is used to drive the tuning fork of the assembly 111 in a resonant mode and is also applied to the detector 109. The mechanically modulated output of the voltage follower 106 has a D.C. amplitude and polarity which are dictated by the amplitude and phase of the electrically induced signal relative to the reference signal. The output of the phase sensitive detector 109 is fed to the integrator 117 which produces an output signal equal to the potential on the electrode 17.

The output of the voltage follower 106 is constituted by a carrier signal corresponding to the reference signal mechanically modulated by the assembly 111. The modulated signal is recovered by the detector 109 through combination of the input signal with the reference signal from the oscillator 113.

In summary, it will be seen that the present invention overcomes the drawbacks of the prior art and provides a sensing electrode arrangement for an electrostatic copying machine or other electrostatographic apparatus which enables higher signal output and greater accuracy in sensing. The apparatus is also immune to electrical noise generated in other sections thereof. Various modifications will become possible for those skilled in the art after receiving the teachings of the present disclosure without departing from the scope thereof.

What is claimed is:

1. An electrostatographic apparatus including a photoconductive member and image forming means for forming an electrostatic image on the photoconductive member, characterized by comprising:

an electrode disposed closely adjacent to the photoconductive member; and means for maintaining a capacitance between the electrode and the photoconductive member greater than a capacitance between the electrode and ground;

said means comprising an electrically conductive shield having a separate first shield member disposed closely adjacent to and covering a surface of the electrode which faces away from the photoconductive member and a separate second shield member which surrounds a periphery of a surface of the electrode which faces the photoconductive member, and a voltage follower having an input connected to the electrode and an output connected to the shield.

2. An apparatus as in claim 1, in which said means comprises a plurality of projections and depressions formed on a surface of the electrode facing the photoconductive member.

3. An apparatus as in claim 1, in which the first shield member comprises a mesh.

4. An apparatus as in claim 1, further comprising developing means for applying toner to the photoconductive member to form a toner image and bias means connected between the voltage follower and the developing means for applying a developing bias voltage to the developing means corresponding to an output of the voltage follower.

5. An apparatus as in claim 4, further comprising sample and hold means connected between the voltage follower and the bias means for sampling and holding an output voltage of the voltage follower corresponding to an edge portion of the electrostatic image on the photoconductive member.

6. An apparatus as in claim 5, in which the sample and hold means comprises a re-hold circuit.

* * * * *